US005727457A

United States Patent [19]

Olive

[11] Patent Number: 5,727,457

[45] Date of Patent: Mar. 17, 1998

[54] HYDRAULIC PRESS FOR FORMING DOOR FRAMES AND PANELS OR THE LIKE

[75] Inventor: Juan Guarch Olive, Benicarlo (Castellon), Spain

[73] Assignee: Prensas Ramarch, S.L., Spain

[21] Appl. No.: 601,345

[22] Filed: Feb. 16, 1996

[30] Foreign Application Priority Data

Oct. 5, 1995 [ES] Spain ..... 9502549

[51] Int. Cl.[6] ..... B30B 7/04

[52] U.S. Cl. ..... 100/232; 100/237; 100/257; 100/269.06

[58] Field of Search ..... 100/193, 208, 100/219, 226, 231, 232, 237, 269.06, 269.12, 269.17, 257

[56] References Cited

U.S. PATENT DOCUMENTS

| | | | |
|---|---|---|---|
| 585,906 | 7/1897 | Carter | 100/232 |
| 791,102 | 5/1905 | Mayhew | 100/237 |
| 2,618,302 | 11/1952 | Rockola | 100/232 |
| 3,771,779 | 11/1973 | Mortoly | 100/232 |
| 4,141,775 | 2/1979 | Williams et al. | 100/237 |

FOREIGN PATENT DOCUMENTS

| | | | |
|---|---|---|---|
| 223798 | 10/1962 | Austria | 100/257 |
| 0 424 357 | 10/1990 | European Pat. Off. . | |
| 0 518 217 | 12/1992 | European Pat. Off. . | |
| 1 196 844 | 7/1965 | Germany . | |
| 91 06 635.2 | 10/1991 | Germany . | |
| 43 15 606 | 2/1994 | Germany . | |

*Primary Examiner*—Stephen F. Gerrity
*Attorney, Agent, or Firm*—Nath & Associates; Gary M. Nath; Harold L. Novick

[57] ABSTRACT

A rigid frame hydraulic press that includes a frame on which are mounted a series of movable columns that are used for vertical pressing and an end column that is used for horizontal pressing. The end column has a complementary support in its lower part located between its crossbars. The rear of the end column has opposing cylinders for positional anchoring on multibore plates, while the front of the end column has small transverse cylinders to exert pressure toward the opposite side of the frame. The movable columns have a "U"-shaped structure and a cylinder housed in a grooved guide with a sliding carriage. The cylinder has a fixed end that is attached to the upper part of the column and has a mobile end that is joined to the sliding carriage. The cylinder moves along the length of the inside of the carriage when pressure is applied to it, and the joint of the fixed end is at a given height with respect to the lower end of the column as a function of the length of the cylinder.

7 Claims, 7 Drawing Sheets

HYDRAULIC PRESS FOR FORMING DOOR FRAMES AND PANELS OR THE LIKE

FIELD OF THE INVENTION

The present invention relates to hydraulic presses, and in particular relates to a hydraulic press for forming door frames and panels.

BACKGROUND OF THE INVENTION

In order to make elements such as door and/or window frames, or their panels when they are composed of joined union of elements, it is necessary to press in the required directions to join the constituent elements, and at the same time to make the necessary squaring for the correct configuration.

For this purpose it is necessary to use assembly supports with which the elements to be joined are pressed. These determine the frames or panels to be made, and frame bearing columns are positioned in a known way. For example, pressing means are incorporated in one direction, while other elements are incorporated on the frame for perpendicular pressing.

Such is the case of 1964 German Patent 1,196,844, in which there was already a framework with frames bearing cylinders (11 and 12) that extend in the horizontal direction and other cylinders (13 and 14) that extend in the vertical direction.

The executions found in European Patents 424,357 and 518,217, in German Utility Model G 91 06 635.2 and in German Patent DE 43 156 06 are known as later solutions within this same concept.

In the last mentioned reference, the vertical cylinders have a large longitudinal size, coinciding with that of the vertical guides of the corresponding support frame or skeleton. Thus, in addition to a thrusting action, a pulling forward of the piece is realized. This solution has the drawback, among others, of excessive cylinder size which complicates the manufacture of the machine and limits the functional accuracy thereof.

SUMMARY OF THE INVENTION

In order to offer a more adequate solution to the problem, according to the present invention a new press is disclosed which has been structurally conceived according to construction and functional features that make it particularly advantageous with respect to the known devices.

In effect, the press which is the object of the present invention has a determining structure formed by a rigid frame that includes spaced apart crossbars between which are mounted a series of mobile columns arranged on a sliding assembly. One of the end columns has opposed cylinders mounted to the rear part and arranged longitudinally.

The opposed cylinders establish an anchoring block at selective positions on a plurality of multibore plates mounted parallel to the frame crossbars. On the front part of this end column there are mounted small transverse cylinders which are used to exert a pushing pressure against the opposite side of the frame.

Each one of the other columns has a "U" shape and incorporates a cylinder in the rear part arranged longitudinally and housed within a grooved guide. This cylinder has a mobile and a fixed end. The mobile end is attached to a carriage that slides on the guide, to which, through the column structure, a perpendicular plate is frontally joined. The perpendicular plate correspondingly faces a fixed counterplate which may be selectively positioned along the length of the column. The fixed end of the cylinder is attached to the upper part of the column in a thrusting arrangement on the carriage, or on the housing guide itself, but at a distance from the lower end of the column.

In this manner a press of very simple execution is obtained, in which the operating cylinders of the press can be of a very reduced length, thus favoring functional precision for the elements to be made and allowing very reliable results to be achieved.

The recommended press therefore has considerable advantages with respect to the conventional presses meant for the same function, the following characteristics being worthy of emphasis:

- Greater pressing efficacy for an equal casing diameter of the cylinders used;
- Reduction in warping effects in cylinder stems, due to their short length;
- The elements (guides, shafts and cylinders) of the pressure mechanism are perfectly protected behind the structure in the vertical columns;
- The aforementioned vertical columns offer a large support surface for the parts to be pressed, these being safe from greases and oils;

It is not necessary to supplement or move the parts to be pressed, since once they are positioned on the press, it is sufficient to operate the pressure elements, without having to move the parts at all; and

- The squaring of the pressed parts is totally accurate and reliable, since the horizontal cylinders absorb the possible out-of-squareness of the column in their run, while the fixed side against which the pressing is performed is perfectly squared with respect to the lower counterplates of the vertical press.

As a result, this press which is the object of the present invention therefore has considerable advantageous characteristics, which give it a life of its own and a preferred character for the function for which it is meant.

DETAILED DESCRIPTION OF THE PREFERRED EMBODIMENTS

Figure 1:
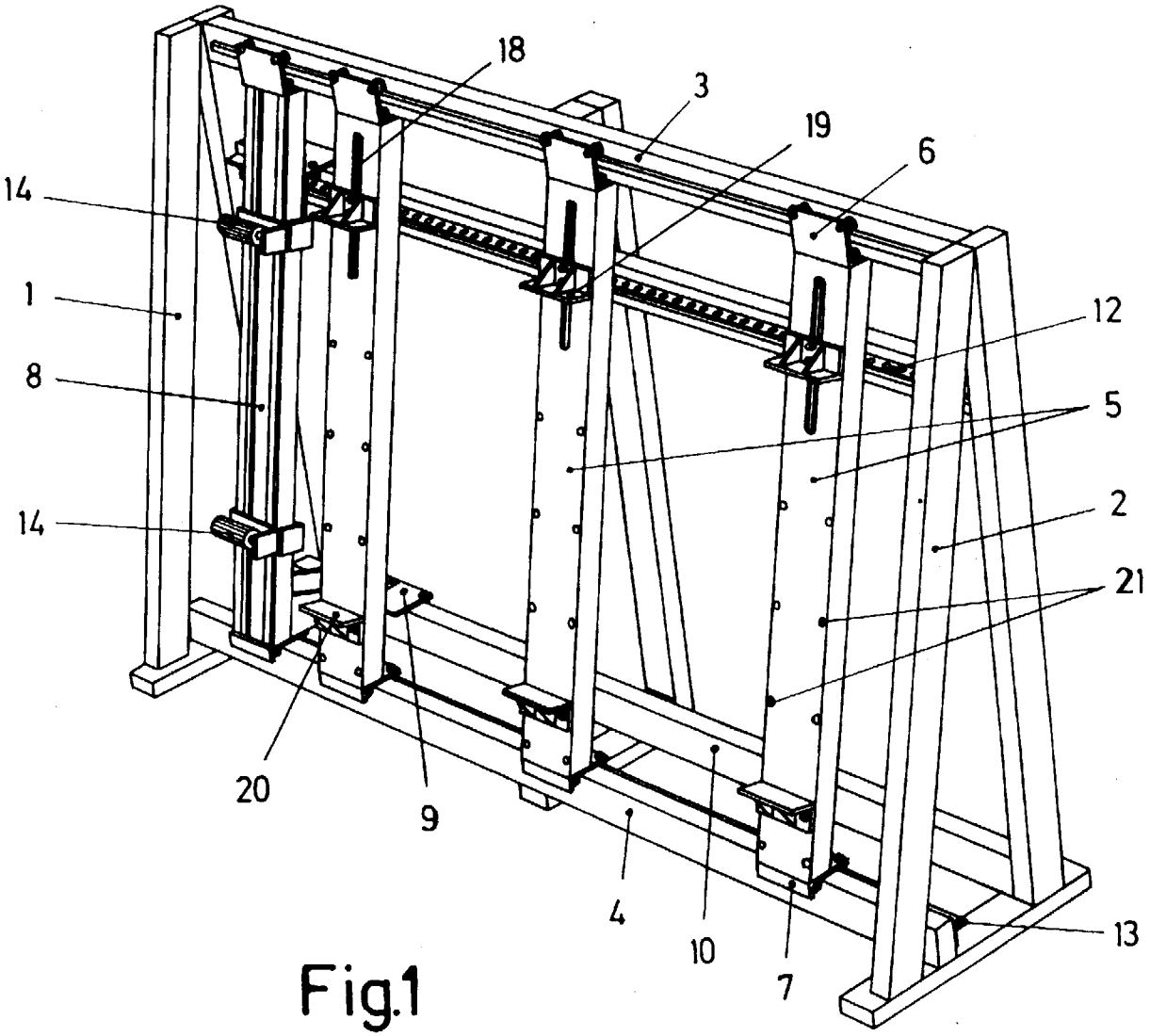
FIG. 1 is a perspective view of an assembly of a press according to the present invention.
Figure 2:
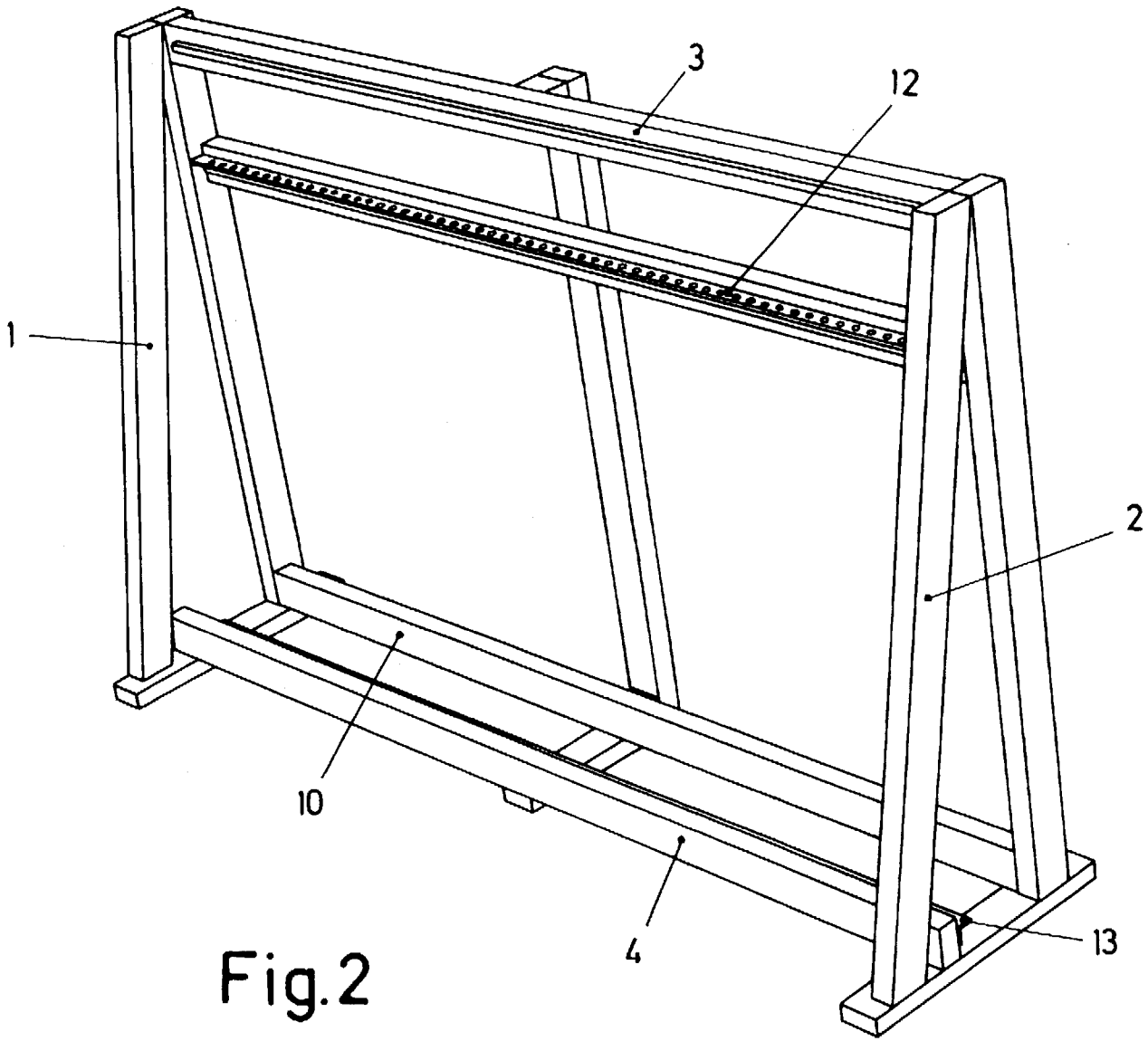
FIG. 2 is a perspective view similar to that depicted in FIG. 1 with the mobile columns having been removed from the bearing structure.

The object of the invention is a press for the construction of door frames and panels and the like. The press includes a determining structure having a rigid frame formed by sides (1) and (2) and respective crossbars (3) and (4) located at the upper part and the lower part of the frame.

Extending between crossbars (3) and (4) is a series of columns (5) which are connected to crossbars (3) and (4) respectively by carriages (6) and (7) which provide a sliding arrangement that allows the free movement and placement of each one of these columns (5) along crossbars (3) and (4).

At one end of the press is a perpendicular end column (8). Column 8 is mounted in the same sliding manner as columns (5) on crossbars (3) and (4), but also has a complementary lower support (9), mounted with a similar sliding assembly on a rear crossbar (10) located in the structure in the same lower part as crossbar (4).

Figure 3:
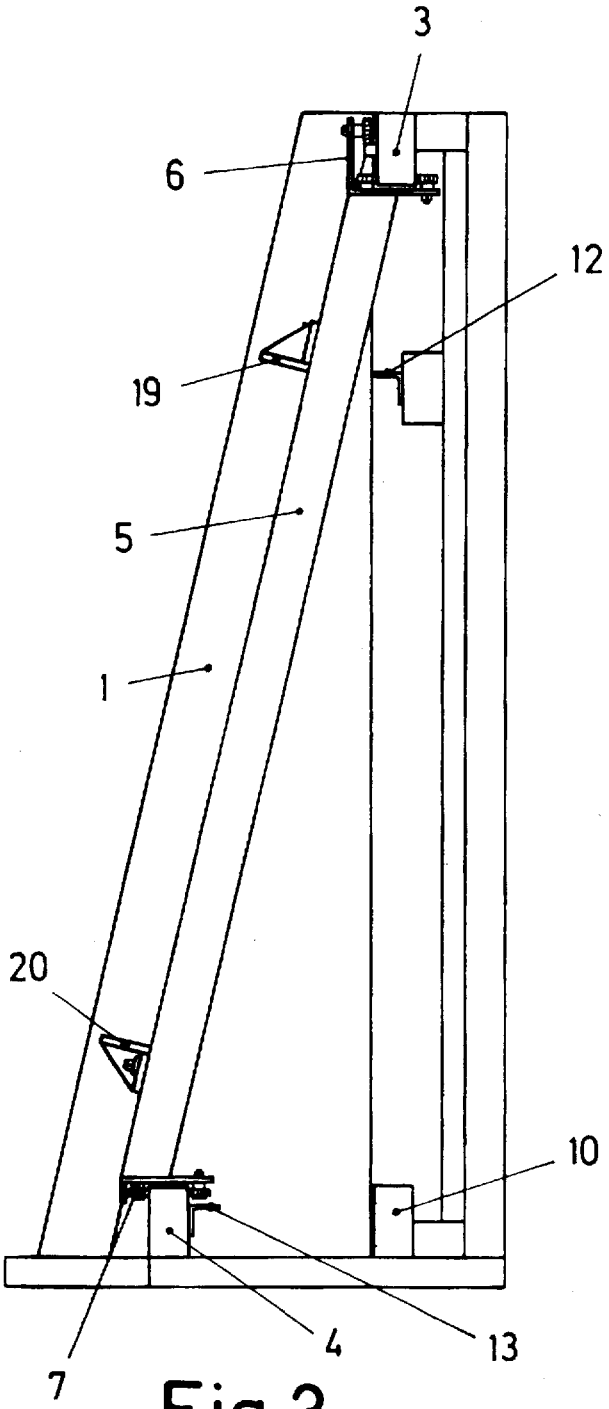
FIG. 3 is a side elevational view of the press.
Figure 4:
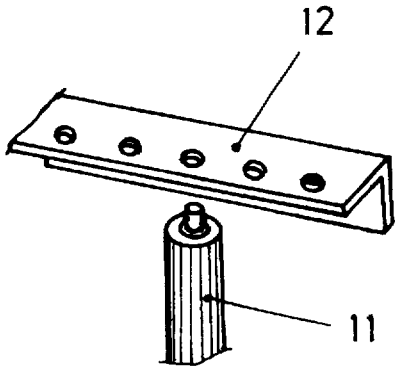
FIG. 4 is a partial perspective view of a detail which depicts the anchoring of the blocking cylinders of the end column which has side pressing cylinders.
Figure 6:
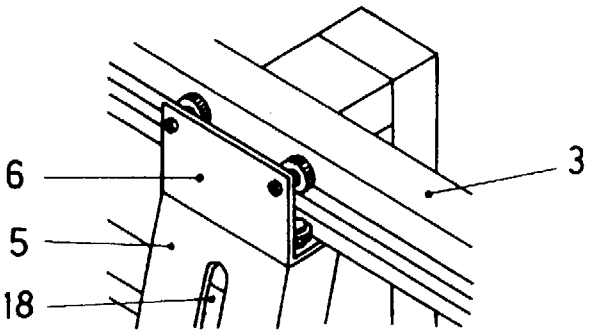
FIGS. 6 and 7 are enlarged partial perspective views showing details corresponding respectively to the connection of the upper and lower assemblies of the same column shown in FIG. 5.
Figure 7:
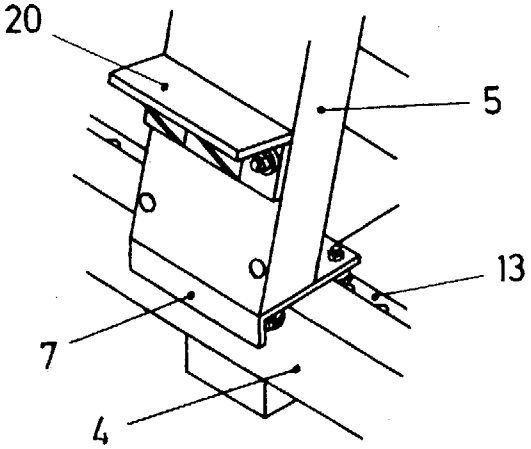
Figure 5:
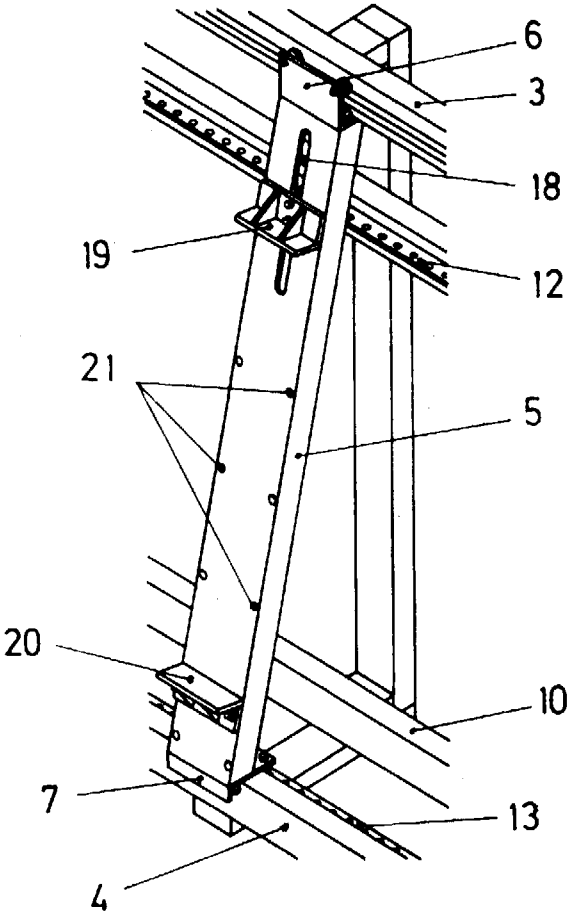
FIG. 5 is a partial perspective view of one of the columns that slides on the structure's crossbars.

As shown in FIGS. 3 and 4, end column (8) is provided at the rear part thereof with cylinders (11), arranged in opposition in a longitudinal direction. Cylinders (11) can be mounted on respective multibore plates (12) and (13) in selected bores thereof, as depicted in the detail of FIG. 4. In this way, column (8) can be positioned in selected fixed positions along the length of the structural assembly.

On the front part of end column (8) are mounted small cylinders (14) arranged in a transverse direction, by means of which pressure can be exerted toward the opposite side (2) of the other end of the structure.

In this way, for the lateral pressing of each frame or panel to be constructed, it is enough to place the frame or panel on the inside face of side (2) of the structure, which is equipped with construction in perfect square or perpendicularity with respect to crossbars (3), (4) and (10). Next end column (8) is moved toward the side of the panel or frame to be constructed, and column (8) is locked into position on multibore plates (12) and (13) with cylinders (11), now located in the position corresponding to the size of the frame or panel. During the operation of cylinders (14) only a short run of their stem is required to exert the necessary pressure on the frame under construction to compress it between cylinders (14) and against side (2) of the structure on which it is resting.

Columns (5) are structurally composed of a "U"-shaped member having a rearward facing internal space in which a cylinder (15) is longitudinally mounted.

A cylinder (15) is mounted on each one of columns (5) and is located in the housing of a grooved guide (16). A carriage (17) is slidingly mounted on guide (16), and through a slot (18) in the "U"-shaped housing of the column, a perpendicular plate (19) is frontally attached to carriage 17.

Figure 8:
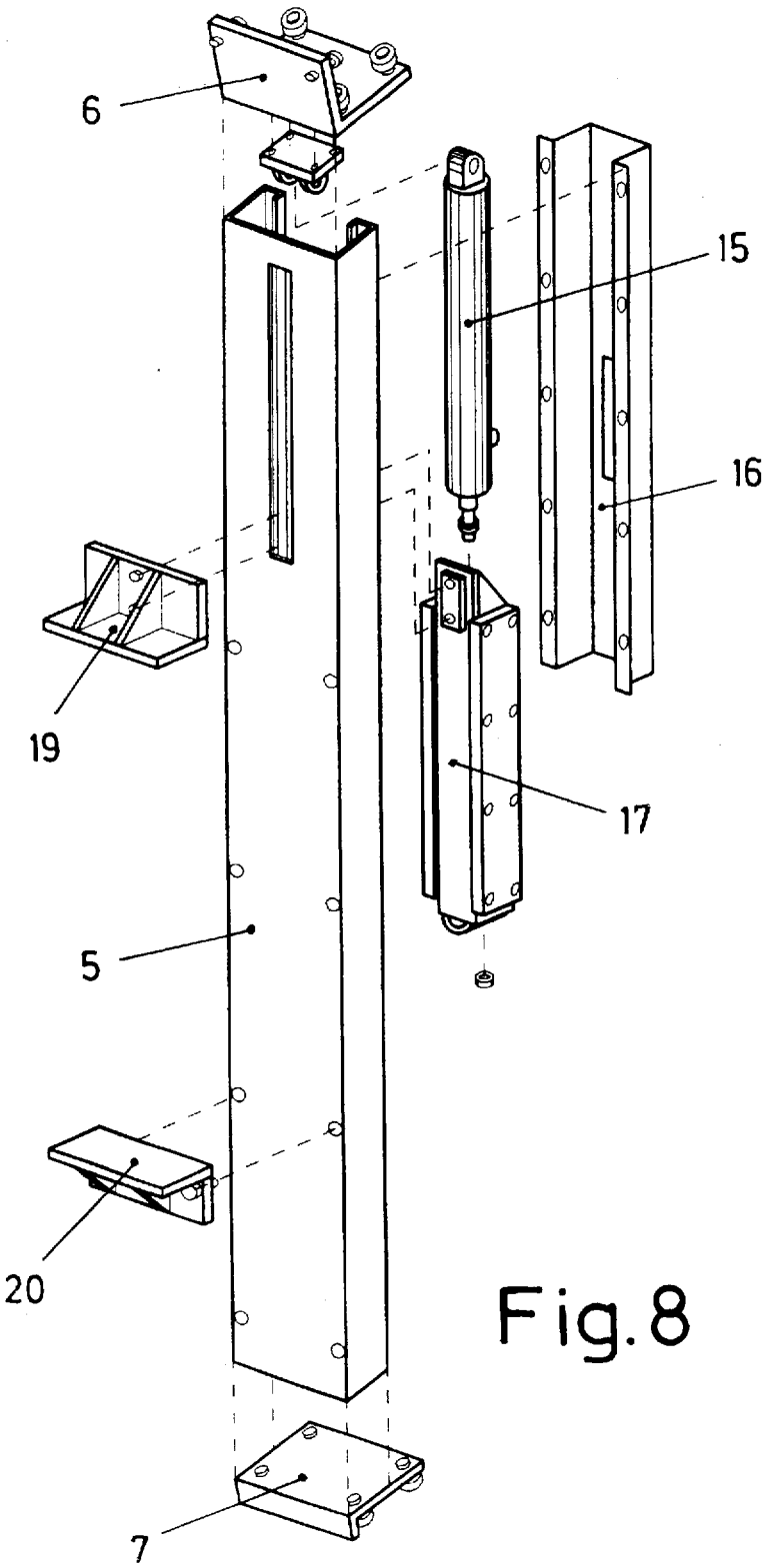
FIG. 8 is an exploded perspective view of one of the vertical pressing columns with the pressure cylinder arranged to apply a thrust on the sliding carriage, from the upper part.
Figure 9:
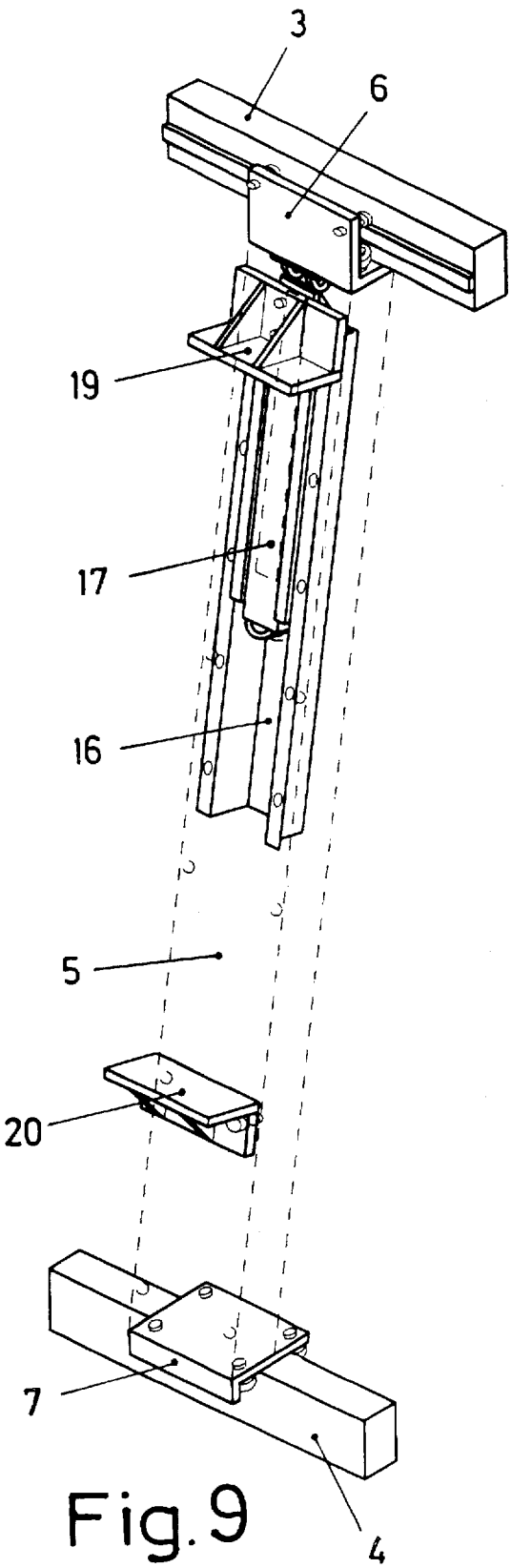
FIG. 9 is a perspective view of a column like that depicted in FIG. 8, but shown mounted on the structure of the same being represented by dotted lines and the pressure cylinder of the rear part in a thicker solid line.
Figure 10:
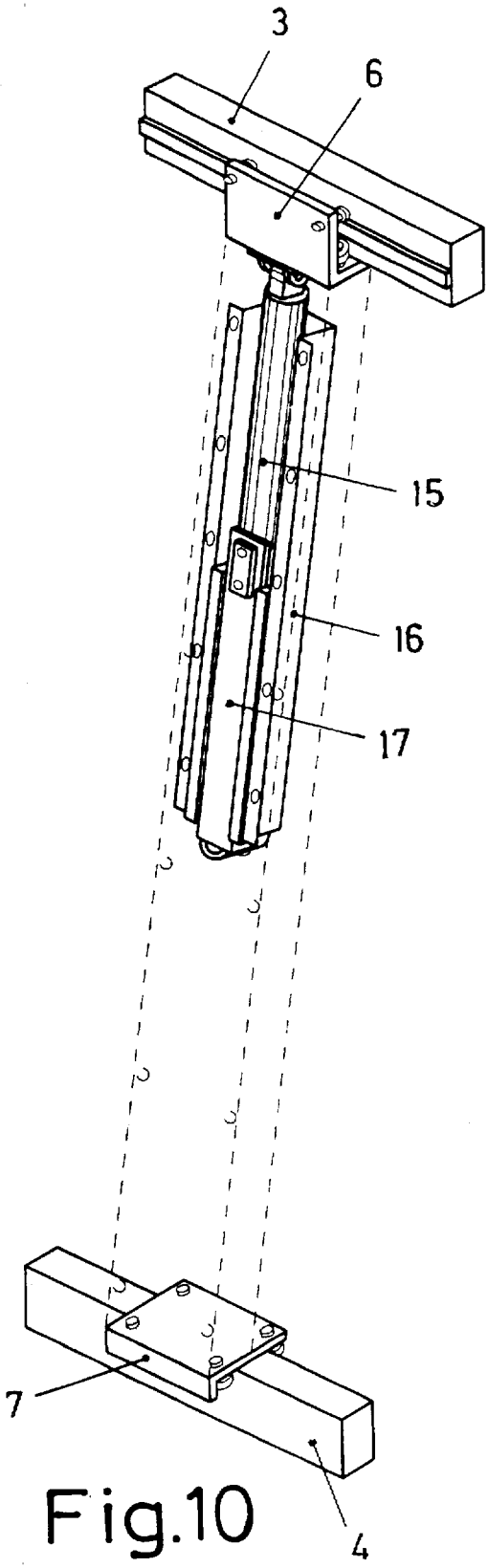
FIG. 10 is a perspective view similar to that depicted in FIG. 9, but with the structure of the column having been eliminated so as to clearly reveal the grooved guide in which the carriage, operated by the pressure cylinder, is housed.

According to a preferred embodiment (see FIGS. 8, 9 and 10), cylinder (15) is rigidly attached at its fixed end to the upper part of column (5) on the corresponding upper carriage (6). The mobile end is attached to sliding carriage (17), passing longitudinally along it to the lower part thereof and to which the mobile end is attached. In this way, carriage (17) can reach the same upper end of column (5) adjacent to plate (19) without leaving a dead section due to the size of cylinder (15). Also, with this arrangement the fixed body of cylinder (15) only requires a length practically equal to that of slot (18) provided as a useful fun for the pressing. In this case cylinder (15) works by compression, pushing carriage (17) so as to exert the pressure. Thus, cylinder (15) operates by extending itself to perform the pressing.

Figure 11:
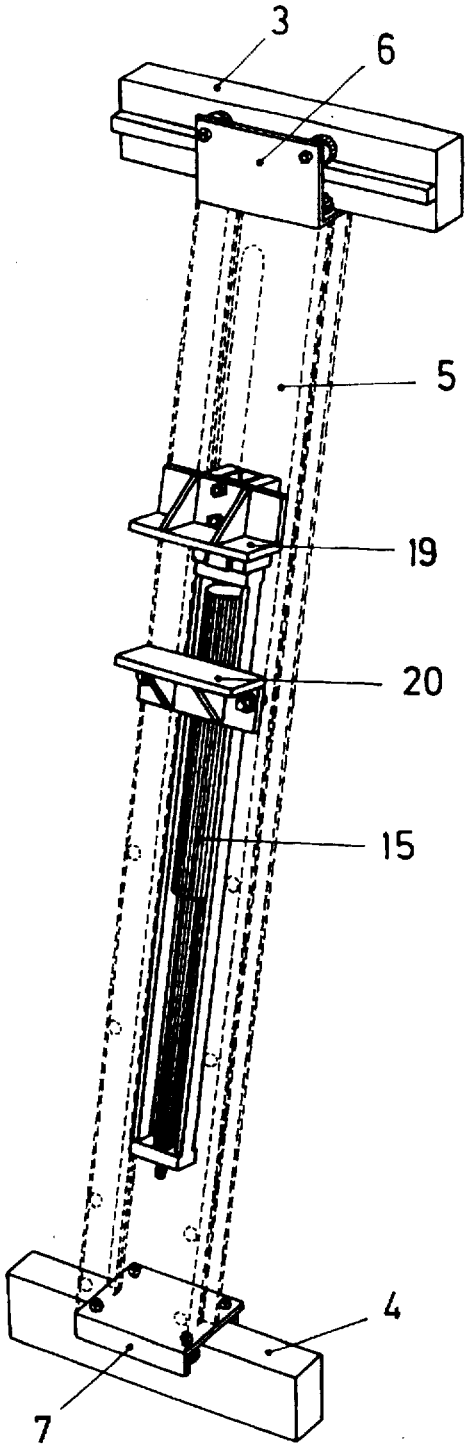
FIGS. 11 and 12 are perspective views, like the above, of a vertical pressing column in which the pressure cylinder is arranged to operate at a given height with respect to the lower end of the column.
Figure 12:
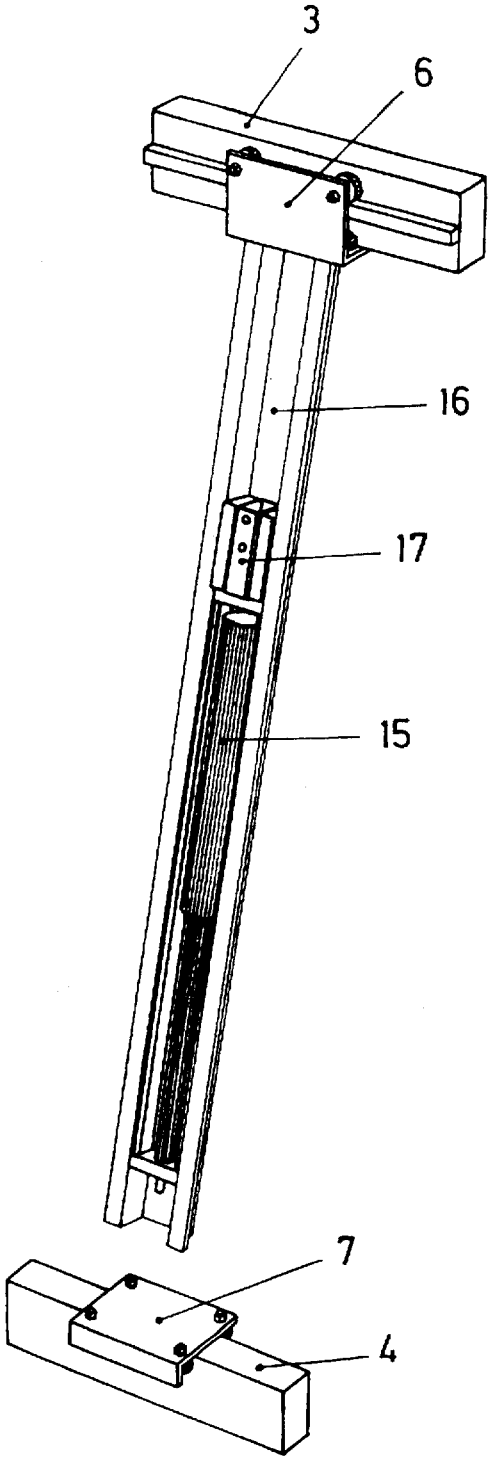

According to another possible embodiment (see FIGS. 11 and 12), the fixed end of cylinder (15) may be attached to guide (16), which also accommodates sliding carriage (17). In this case the attachment to the aforementioned guide (16) is provided at a fixed height with respect to the lower end of column (5). Also, cylinder (15) likewise has a reduced length.

On the other hand, arranged facing the aforementioned plate (19) is a counterplate (20), which is held by screws on the "U" structure of column (5). Counterplate (20) can be placed selectively in different positions along column (5) by securing means using different holes (21), which as shown in FIG. 1 have been provided on the structure for this purpose.

In this way, once the counterplates (20) of the various columns (5) have been placed according to the measurements of the element to be constructed, such as a frame or panel, the latter may be placed on counterplates (20). Then the compression of this element to be constructed is performed by operating cylinders (14) and (15). Cylinder (15) exerts the force necessary for pressing the element between plates (19) and counterplates (20), which is in a direction perpendicular to the pressure exerted by cylinders (14) of end column (8) against side (2) of the structure.

I claim:

1. Hydraulic press comprising a rigid frame defining a vertical direction and a horizontal direction when in use and having crossbars; and multibore plates which extend parallel to said crossbars;

a series of movable columns, means for pressing in the vertical direction;

a moveable end column mounted between said crossbars and having a front part and a rear part which on the rear part thereof are mounted opposing cylinders having means for selectively engaging said bores of said multibore plates, by means of which selective positional anchoring may be established, while on the frontal part of said end column (8) is incorporated small transverse cylinders, by means of which pressure may be exerted toward the opposite side of the frame.

2. Hydraulic press according to claim 1, wherein said frame further includes a lower rear crossbar; and wherein said end column has mounted thereon a complementary support in the lower part thereof, by means of which said end column is slidingly mounted to said rear crossbar.

3. Hydraulic press according to claim 1, wherein said bearing columns of the means of vertical pressure comprise a "U"-shaped structure having a slot, in whose rear part is included a further cylinder housed in a grooved guide, said further cylinder bearing a sliding carriage, and a perpendicular plate attached to said sliding carriage with means extending through said slot, said perpendicular plate facing a fixed counterpart that may be selectively positioned along the length of the column.

4. Hydraulic press according to claim 3, wherein said further cylinder, having a fixed end and a mobile end, is mounted to each column, said further cylinder having said fixed end attached to the upper part of the corresponding column and having said mobile end joined to a sliding carriage, which upon operation provides a downward movement in a pressing action, said further cylinder being attached to the mobile end on the lower part of said carriage.

5. Hydraulic press according to claim 3, wherein said further cylinder, having a fixed end and a mobile end, is mounted on each column with its fixed end attached at a joint on a corresponding sliding guide for a carriage joined at the mobile end, this joint of the fixed end on said guide being limited to a given height with respect to the lower end of said column, as a function of the length of said further cylinder, which is strictly necessary for the mobility provided for the press run.

6. Hydraulic press according to claim 1, wherein a further cylinder having a fixed end and a mobile end is mounted to each column, said further cylinder having said fixed end attached to the upper part of the corresponding column and having said mobile end joined to a sliding carriage, which upon operation provides a downward movement in a pressing action, said further cylinder being attached to the mobile end on the lower part of said carriage.

7. Hydraulic press according to claim 1, wherein a further cylinder having a fixed end and a mobile end is mounted on each column with its fixed end attached at a joint on a corresponding sliding guide for a carriage joined at the mobile end, this joint of the fixed end on said guide being limited to a given height with respect to the lower end of said column as a function of the length of said further cylinder, which is strictly necessary for the mobility provided for the press run.

* * * * *